US005520114A

United States Patent [19]

Guimard et al.

[11] Patent Number: 5,520,114

[45] Date of Patent: May 28, 1996

[54] METHOD OF CONTROLLING DETONATORS FITTED WITH INTEGRATED DELAY ELECTRONIC IGNITION MODULES, ENCODED FIRING CONTROL AND ENCODED IGNITION MODULE ASSEMBLY FOR IMPLEMENTATION PURPOSES

[75] Inventors: André Guimard, Toulouse; Denis Harle, Rouen; Claude Pathe, Hery, all of France

[73] Assignee: Davey Bickford, Rouen Cedex, France

[21] Appl. No.: 120,178

[22] Filed: Sep. 13, 1993

[30] Foreign Application Priority Data

Sep. 17, 1992 [FR] France ..... 92 11111

[51] Int. Cl.[6] ..... F42C 11/06

[52] U.S. Cl. ..... 102/215; 102/206; 361/247

[58] Field of Search ..... 102/200, 202.5, 102/206, 215, 217; 361/247, 251

[56] References Cited

U.S. PATENT DOCUMENTS

| | | | |
|---|---|---|---|
| Re. 33,044 | 8/1989 | Kirby et al. | 102/200 |
| 3,851,589 | 12/1974 | Meyer | 102/215 |
| 4,527,636 | 7/1985 | Bordon | 175/4.55 |
| 4,674,047 | 6/1987 | Tyler et al. | 364/423 |
| 4,712,477 | 12/1987 | Aikou et al. | 102/206 |
| 5,069,129 | 12/1991 | Kunitomo | 102/200 |
| 5,214,236 | 5/1993 | Murphy et al. | 102/217 |

FOREIGN PATENT DOCUMENTS

0434883A1 7/1991 European Pat. Off. .

OTHER PUBLICATIONS

Proceedings of the 9th Conferernce of Explosives and Blasting Technique, 1983 Jan. 31–Feb. 4, pp. 489–496, "The Development Concept of the Integrated Electronic Detonator", by Worsey and Tyler.

*Primary Examiner*—Ian J. Lobo

*Attorney, Agent, or Firm*—Nikaido, Marmelstein, Murray & Oram

[57] ABSTRACT

Method according to which, the programming unit (18) transmits, after completion of the programming of the ignition modules, the delay times also programmed to the firing control unit (17). The firing control unit (17) can interrogate simultaneously the ignition modules (15) which send back the information requested to it. The encoded firing control assembly and the encoded ignition modules enable to implement the process.

16 Claims, 8 Drawing Sheets

METHOD OF CONTROLLING DETONATORS FITTED WITH INTEGRATED DELAY ELECTRONIC IGNITION MODULES, ENCODED FIRING CONTROL AND ENCODED IGNITION MODULE ASSEMBLY FOR IMPLEMENTATION PURPOSES

BACKGROUND OF THE INVENTION

The present invention relates to a method of controlling detonators fitted with integrated electronic delay ignition modules, as well as to an encoded firing control unit and encoded ignition modules for implementation of the method.

In most operations dealing with explosives, the detonation of the charges is triggered according to a precise time sequence, in order to improve the working yield of the explosive and to control its effects better.

Conventionally, the various delay times between the explosions of the charges are obtained according to a pyrotechnic process at the level of the detonators themselves. The detonators are initiated simultaneously by an exploder which delivers a certain electrical energy in a line of fire which connects the detonators in series or in parallel.

However, the pyrotechnic delay generated by the combustion of a delaying pyrotechnic compound exhibits a relative accuracy sometimes insufficient for some applications.

In order to remedy this short-coming, it has been suggested recently to use electronic-type integrated delay detonator ignition devices, which enable making the most of the accuracy achievable in electronics to enrich and fine-tune the delay time ranges that could be obtained in a pyrotechnic way. It has been suggested in the U.S. Pat. No. 4.674,047, as well as in an article covering a conference held by the inventors about the same topic "The Development Concept of the Integrated Electronic Detonator—Worsey-Tyler—Society of Explosives Engineers—Proceedings of the 9th Conference of Explosives and Blasting Techniques—1983 Jan. 31 –Feb. 4" to resort to detonators fitted with electronic means enabling them to communicate with an external control unit. Every detonator has a capacitor whose discharge actuates the explosive charge. The delay times of every detonator can be programmed on site, an identifying code having been assigned to every detonator previously, for instance in the factory. During a firing sequence, the detonators receive orders from the firing control unit, to load the capacitor specified, then to fire. It sends information back to the firing control unit, enabling the control unit to control the correct operation of the firing sequence. To this end, the detonators are fitted with an on-board microprocessor-based intelligence. The delay times programmed are stored on non-volatile memories.

OBJECT AND SUMMARY OF THE INVENTION

The object of the present invention is to propose a method of controlling integrated delay electronic ignition modules, as well as an encoded firing control unit and an encoded ignition module for implementation of the method conveying to the detonators the advantages mentioned hereabove of the integrated electronic delay detonators, but also a great simplicity of manufacture and operation.

The present invention relates to a method of controlling detonators fitted with integrated delay electronic ignition modules, whereas every encoded ignition module comprises a reservoir capacitor which is designed, after loading, to discharge in the ignitor of its detonator in order to generate an electrical firing pulse, a time base as well as a logic unit fitted with a non-volatile memory to store in the ignition module, an explosion delay time for the detonator, during a firing sequence, whereas the ignition modules are capable to communicate with a firing control unit designed for transmitting a loading order of the reservoir capacitor, as well as a firing order and for receiving from the modules data about their condition, a method according to which, before a firing sequence, their delay time is stored in the ignition modules via a programming unit.

According to the invention, the method is characterized in that, once the ignition modules have been programmed, all the programmed delay times are transferred to and stored in the firing control unit using the programming unit, in that the firing control unit can interrogate the ignition modules simultaneously and in that the modules send back the data requested to the firing control unit.

Exchanges between the firing control unit and the ignition modules are made via encoded binary messages.

The communications being supported by a two-wire line, the firing control unit and the ignition modules must be tolerant to deteriorations that the electrical signals can sustain while transiting over such a line.

The messages transmitted to the detonator are encoded in the C(8,4) format.

After encoding, a word formed by 4 bits of information is emitted over the transmission channel, in the form of an 8 bit message.

The introduction of 4 additional bits (control bits) enables the receiver:

- to detect the presence in the message of one or two errors generated by disturbances over the transmission channel,
- to reconstruct the basic information in case the message contains only one error.

The C(8,4) code, used for the present invention is made from a cyclical code C(7,4) to which a parity bit is associated according to the value of the other 7 bits of the message.

After reception of a message, the ignition module goes through a decoding phase enabling to recover the 4 information bits of this message. In case an error detected cannot be corrected, an error message is sent back to the firing control unit.

Two types of message can be received by the detonator:

a command, a delay + a serial number.

When the ignition module is in reception mode, it knows the type of message which is going to be transmitted. Indeed, every reception is preceded by the reception of an appropriate command.

After reception and decoding of a command, the logic unit of the ignition module switches to the appropriate function.

The time base of every ignition module is advantageously measured during the programming of the corresponding module in delay time.

Preferably, the delay times are different for every module and the modules send back the data requested after a time allowed for feedback of information, in relation to the delay time stored in memory of each of them, said firing control unit opening reception time windows for every module corresponding to the feedback time.

The firing modules advantageously send the data requested back to the firing control unit according to a time sequence corresponding to the firing time sequence.

Preferably, the firing control unit interrogates simultaneously, via a test order, the on-line ignition modules before the loading phase and the firing phase, then the ignition modules send back to the firing control unit global information about their working condition.

The subject of the invention is also an encoded firing control unit comprising a firing control unit and integrated electronic delay ignition modules for detonators which are linked electrically on-line to said firing control unit.

The encoded firing control unit is characterised in that the link between the firing control unit and the ignition modules is used for the supply of current to the ignition modules, as well as for the communications between firing control unit and the ignition modules and in that it comprises a programming unit.

The encoded unit is completed advantageously by the various following characteristics, taken individually or according to all their technically possible combinations:

- the ignition modules comprise means which enable them to send data to the firing control unit in the form of an overconsumption of the line current, whereas the firing control unit is fitted with means for detection of the line current overconsumption with respect to the average consumption of the ignition modules;
- every ignition module comprises an RC based clock;
- the programming unit can communicate separately with every ignition module, to store the explosion delay times inside the ignition modules and the firing control unit is capable to transmit the firing phases during a firing sequence;
- the programming unit is fitted with means for storing all the delay times which are programmed in the ignition modules. The firing control unit and the programming unit are capable to communicate in order to enable the transfer of all the delay times programmed, before a firing sequence;
- the firing control and programming units are fitted with encoding means designed to limit their access to authorized people and with means for their internal mutual recognition before the transfer of the delay times programmed from the programming unit to the firing control unit.

This invention also relates to a detonator ignition module comprising a supply circuit, a communications interface, a management circuit of the pyrotechnic charge, a reservoir capacitor dedicated after loading to discharge in an ignitor of the detonator and a logic unit for the management of the unit.

According to the invention, this ignition module is characterised in that the management circuit of the pyrotechnic charge comprises, mounted in series with the reservoir capacitor, a supply source, for instance the line voltage, a transistor to control the charge of the reservoir capacitor and a resistor linked by one of its pins, which is not linked directly to the reservoir capacitor, to a switching transistor to discharge the reservoir capacitor to the ground.

Taking into account the environment in which these ignition modules are designed to be used, the structural simplicity of the ignition modules offered by the invention enables to ensure great reliability of use. Especially the means of communications between the ignition modules of the invention and their control unit in the line of firing are extremely simplified. Also, the ignition modules and the detonators will all be identical and encoded, from the point of view of their manufacture; they could only be individualised on site during the programming of the delay time.

These ignition modules are not polarised. They can be used in large quantities (200 and more), mounted in parallel, without causing problems which could be due to an excessive line current.

Another advantage of the invention derives from that the detonators of the firing units exhibit high operating safety. The ignition modules are deprived of internal energy sources and do not exhibit any risks of untimely ignition outside firing sequences. Procedures to limit access to the programming of the modules and to the control of the firing sequences have been designed, especially with an encoded coupling between on the one hand, the programming unit and the firing control unit, and on the other hand, the firing control unit and the ignition modules.

Preferably, the impedance between the supply of the management circuit of the pyrotechnic charge and the ignitor is high enough so that the current generated by the line voltage in the ignitor is, whatever the condition of the control transistors, less than the value of the non-trigger limit current of the ignitor. The discharging resistor of the reservoir capacitor is advantageously of a sufficient value so that the current generated by the supply in the ignitor is, whatever the condition of the control transistors, less than the value of the non-trigger limit current of the ignitor.

BRIEF DESCRIPTION OF THE DRAWINGS

The following description is purely for illustration purposes and not exhaustive. It must be read by reference to the appended drawings on which.

DETAILED DESCRIPTION OF PREFERRED EMBODIMENT

Figure 1:
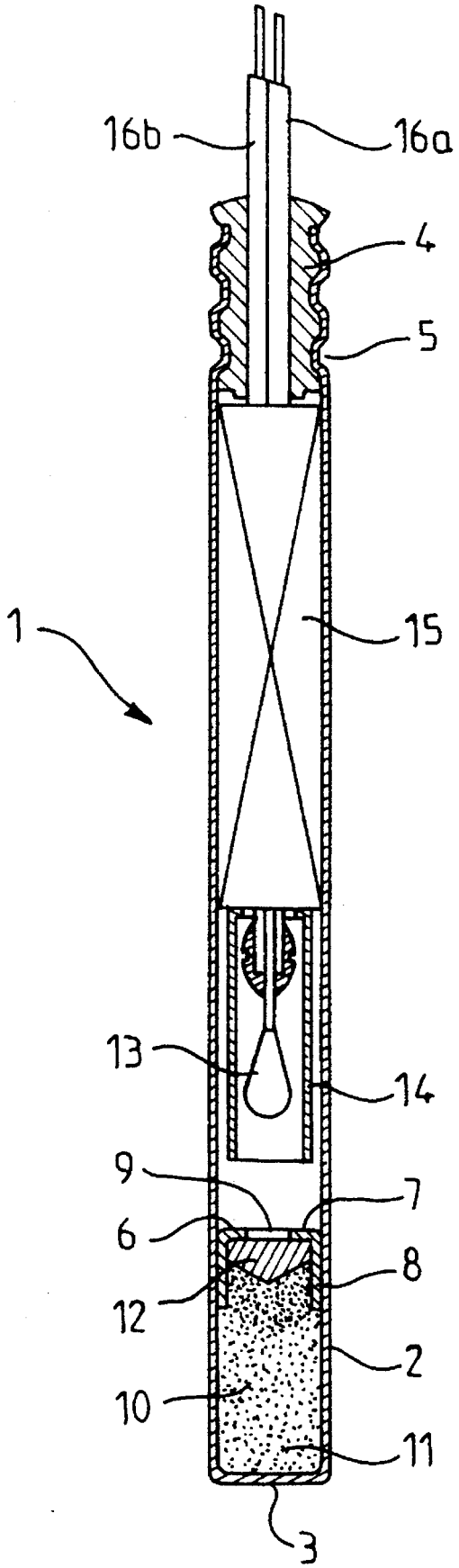
FIG. 1 is a schematic representation of a detonator fitted with an integrated electronic delay ignition module according to an embodiment of the invention.

The integrated electronic delay detonator represented on FIG. 1 comprises a case 1 which serves as a housing and whose body section 2 exhibits an elongated cylindrical shape, terminated by a bottom 3 at one of its ends. At its other end, this case 1 is closed by a plug 4 which is also elongated. The walls of the case 1 are linked to the plug 4 via a crimping 5. The case 1 is made of an aluminium alloy, whereas the plug 4 is made of standard PVC.

The bottom end 3 of the case is connected to a percussion cap made of a member 6 with a bottom 7 arranged according to a straight section of the case 1 and bordered by a cylindrical skirting 8 running from the bottom 7 to the bottom 3. The external walls of the skirting 8 hug more or less the internal walls of the case 1. The thickness of the bottom 7 of this interior percussion cap 6 is drilled by a bore 9 whose contour is a circle centred around the axis of the case 1. This interior percussion cap 6 defines with the bottom 3 and the walls of the body section 2 of the case 1 a chamber 10 containing internally a charge 11, such as nitropenta. The charge 11 includes a priming mixture 12 arranged in the chamber 10 at the level of the interior percussion cap 6. The proportions of the nitropenta and of the priming mixture are 0.6 g and 0.2 g respectively.

An ignitor 13 is axially provided in the case 1 protected by a cylindrical envelope 14. The ignitor 13 is positioned in the chamber 10 opposite the percussion cap 6. This ignitor 13 is linked directly to an integrated delay electronic ignition module 15 arranged in the case 1 between the envelope 14 and the plug 4. This electronic module 15 is supplied with current, at its end, at the level of the plug 4, by two isolated sheathed wires **16*a* and 16*b* which run through the plug 4 along its height and connect the module 15** to the ignition circuit.

A current having an intensity above the operating threshold intensity initiates the ignitor 13, which energizes the charge 12 through the interior percussion cap 6 in the opening 9 and triggers the detonation.

Figure 2A:
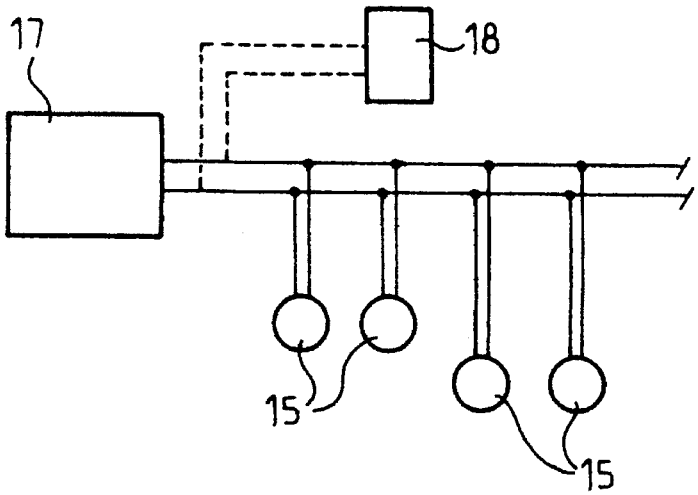
FIGS. 2A, 2B and 2C are schematic representations of a firing unit comprising parallel-mounted detonators, of the type represented on FIG. 1, showing the communications circuits established respectively during firing, programming and transferring of the programming information to the firing console.
Figure 2B:
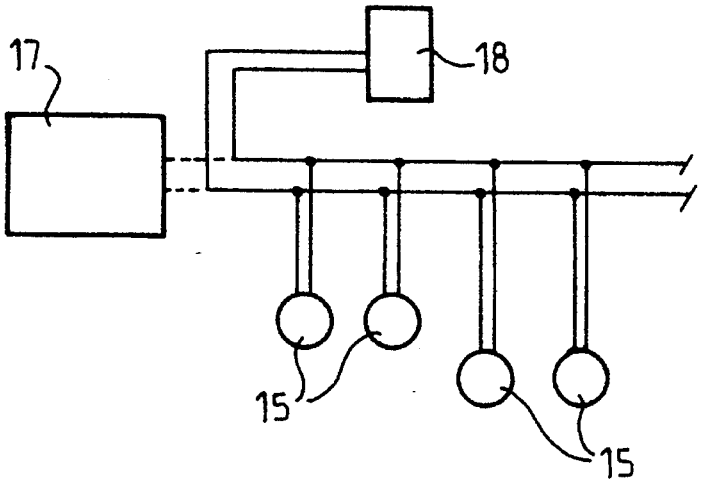
Figure 2C:
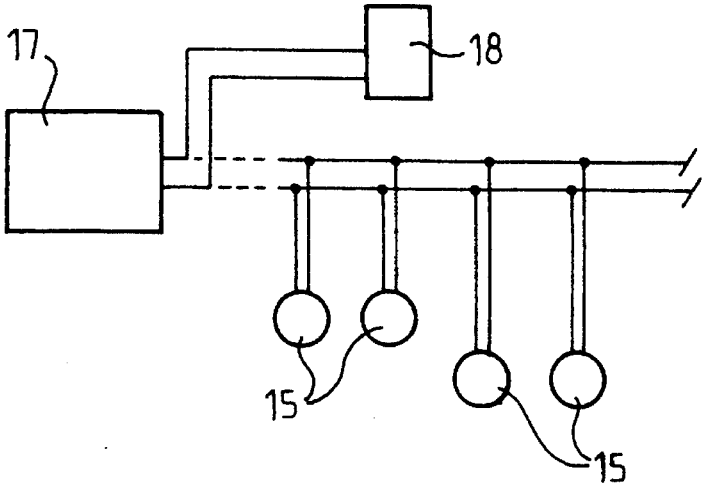

If we now refer to FIGS. 2A, 2B and 2C, we see that the ignition module 15 of the detonators are connected on-line in a parallel network to a firing control unit 17, also called the firing console. The firing unit also comprises a programming unit 18 or console. This is designed to enable the programming of every module 15, before location in a hole, and especially the storing the delay time in each module 15 which has been dedicated to that module. The programming console 18 also enables the delay times to be stored and programmed in the firing control unit 17.

FIG. 2A shows the firing unit connected during a firing sequence. The firing control unit 17 is linked to the detonators, whereas the programming console 18 is then inactive.

FIG. 2B shows the firing unit in a first connected condition before a firing sequence. The programming unit 18 is linked to the ignition modules 15 in order to programme the delay times of the ignition modules.

FIG. 2C shows the firing unit in a second connected condition before a firing sequence. This second connected condition enables, after programming of the ignition modules 15 via the programming console 18 the transfer of the delay times thus programmed to the firing control unit 17.

Figure 3:
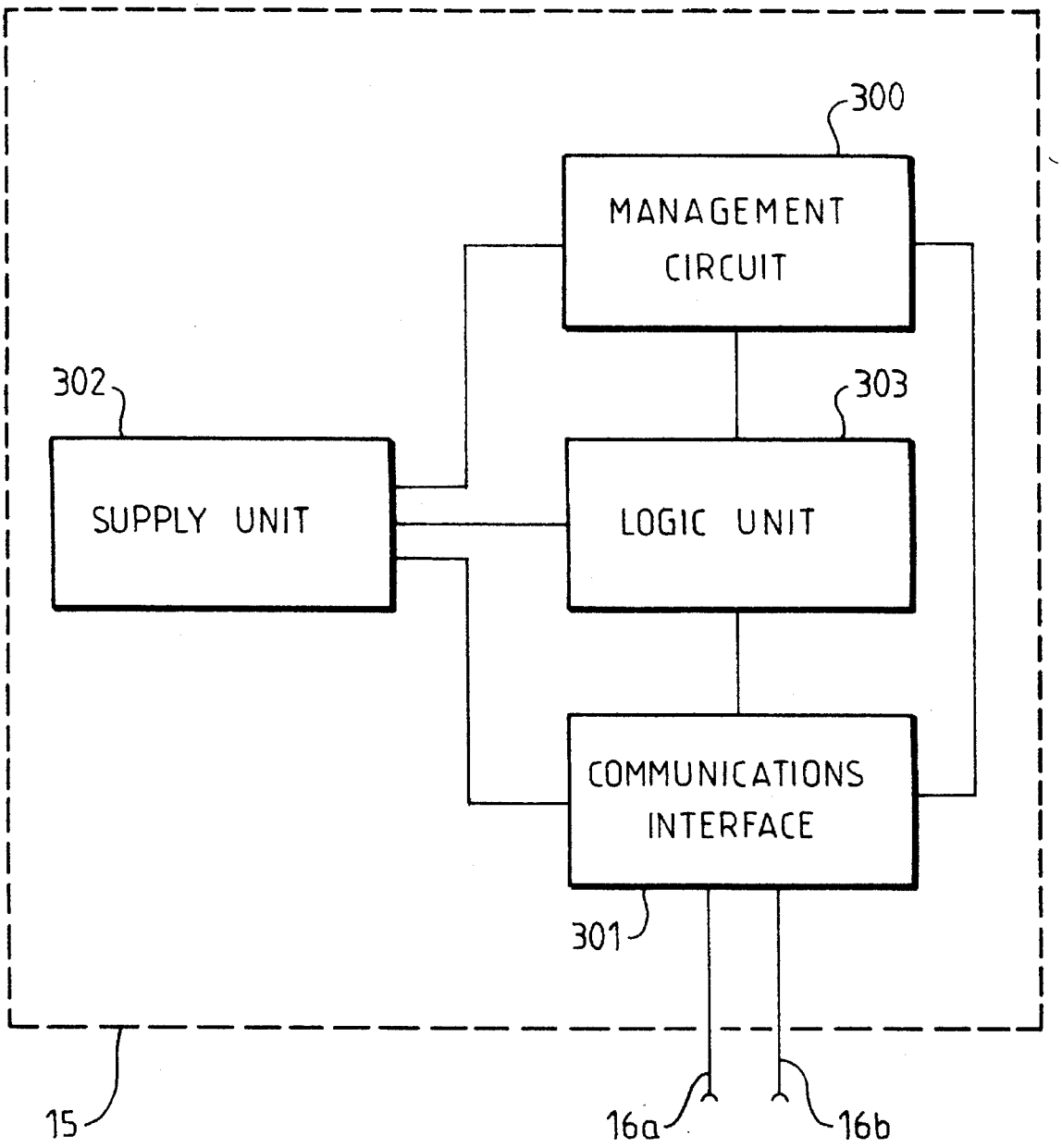
FIG. 3 is an overview of the ignition module according to the invention.

An ignition module 15, such as represented schematically on FIG. 3 comprises four sub-assemblies: a management circuit 300 of the pyrotechnic charge, a communications interface 301, a supply circuit 302, and a logic unit 303 to manage the whole microsystem.

Figure 4:
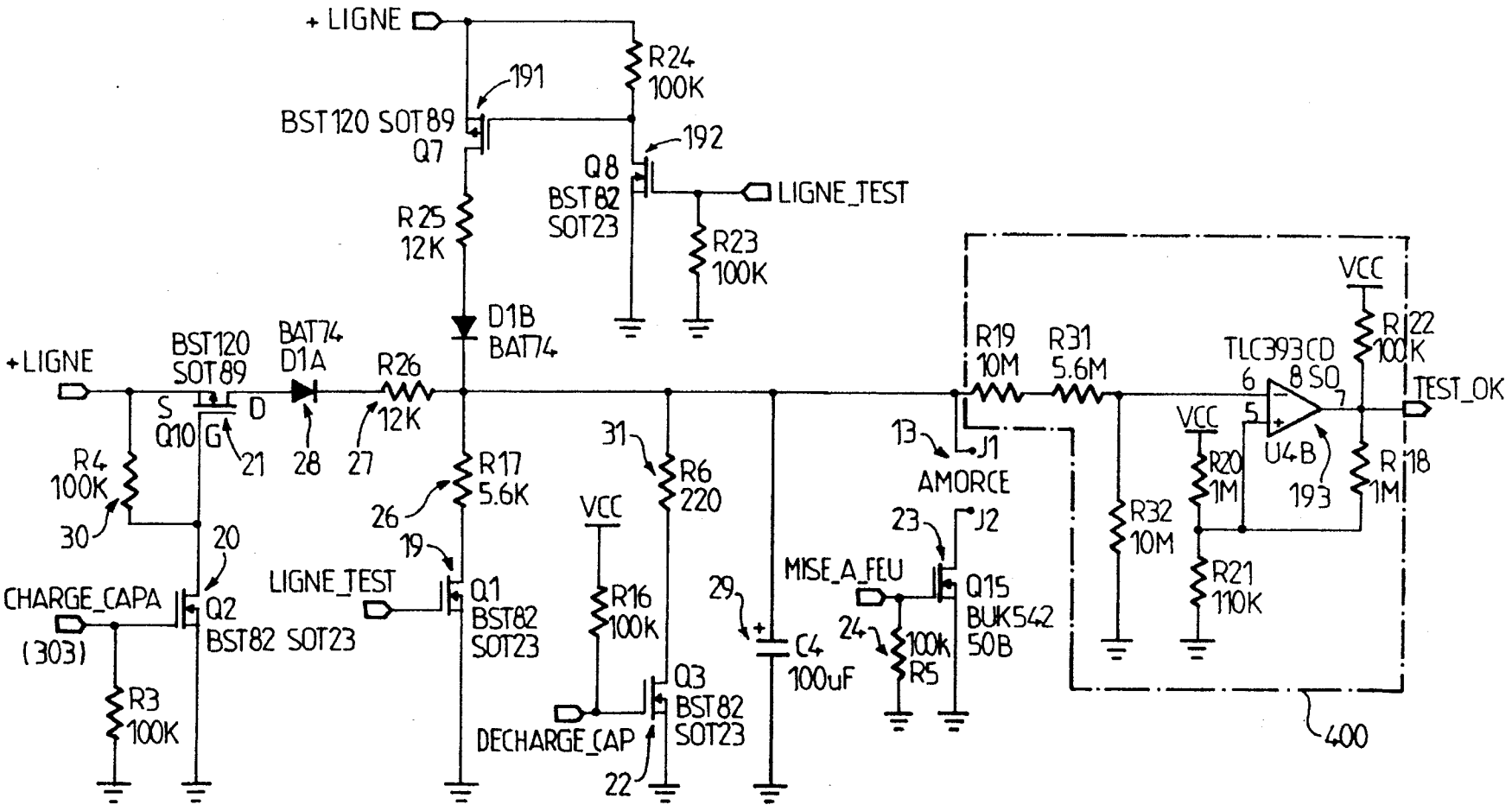
FIG. 4 is a representation of the management circuit of the pyrotechnic charge of an ignition module according to the invention.

The management circuit of the pyrotechnic charge has been represented more specifically in FIG. 4. This circuit comprises mainly five N-channel MOS field effect transistors referred to in the diagram by 19, 20, 22, 23 and 192 and two P-channel MOS field effect transistors, referred to on the diagram by 21 and 191.

The transistor 19 is mounted on a common source mode, with the source being grounded. Its drain is linked, via a resistor 26, to the testing circuit of a capacitor 29 which forms up the reservoir capacitor of the ignition module. Its gate is linked to a test line voltage.

The transistor 20 is mounted to a common source and grounded by its source directly. Its gate is linked to the logic unit of management 303 of the detonator firing microsystem from which it receives the order to load the capacitor 29. Via its drain, the transistor 20 is linked to the gate of the transistor 21. A resistor 30 is connected between the gate and the source of the transistor 21.

The transistor 21 is linked via its drain to a reverse feedback diode 28, which is conducting for the currents going through it, from transistor 21 to a 12 kohm resistor 27. The resistor 27 is mounted in series with the diode 28 and the transistor 21. These three components connect a pin of the ignitor 13 to the line voltage L.

The resistor 27 and the ignitor 13 are also connected by their common pin J1 to one of the pins of the capacitor 29, whose other pin is grounded. This capacitor 29 is a 100 μF capacitor.

The transistor 22 forms a discharging circuit with a resistor 31 without firing the reservoir capacitor 29. When the discharging order of the capacitor 29 is given to transistor 22, this transistor 22 closes and grounds the capacitor 29 via both its pins. The capacitor 29 then discharges via the resistor 31.

The transistor 23 is linked via its drain to the other pin, J2 of the ignitor 13 with respect to that linked to the line voltage L. The source of transistor 23 is linked to the ground and its gate is linked to the logic unit 303 in order to receive a firing control signal. A resistor 24 is connected between the grid of the transistor 23 and the earth.

The sole function of the transistor 20 is to adjust the voltage level between the outputs of the microsystem management logic unit 303 and the controls of the other transistors. The loading of the reservoir capacitor 29 is controlled by the transistor 21, which is designed to connect the capacitor 29 to the line voltage L. The closing order is transmitted to the transistor 21 via the level adapting transistor 20.

The transistor 23 is the firing device of the charge. When tile firing order is transmitted to transistor 23, the former closes and grounds the pin of the ignitor 13 which is not connected to the capacitor 29 already. The capacitor 29 discharges in the ignitor 13 and triggers the firing sequence.

A circuit 400 comprising a comparator 193, used to quantify the voltage of the capacitor 29, ensures the link between the management circuit and the microcontroller 45 of the logic unit 303.

The circuit mounted on FIG. 4 gathers all the necessary management elements of the firing process: the transistor 23 switches the pyrotechnic charge; the transistors 20 and 21 load the firing capacitor 29; the transistor 22 forms, with the resistor 31, the discharging circuit of the capacitor 29; and the transistors 19, 191 and 192 form a testing circuit of the capacitor 29 and of the ignitor 13.

As soon as the system is switched on, the circuit shows the following condition: the transistor 20 is open, consequently the transistor 21 is also open and the capacitor 29 cannot be loaded. The transistor 22 is closed and any possible load of the capacitor 29 is discharged. The transistors 19 and 191 are open which causes the testing circuit to be off. The transistor 23 is open which ensures that no current can flow through the ignitor 13.

For a current to be considered as potentially dangerous and liable to fire the ignitor 13, both transistors 21 and 191 must have failed closed, the transistor 22 must have failed open and the transistor 23 must have failed closed: all actions to be simultaneous. This possibility is rather unlikely. Should it happen, the ignitor would be linked to the line voltage L via the transistor 21 and the 12 kohm resistor 27. Taking into account the importance of the impedance presented by the ignitor 13 and the resistor 27, the maximum current going through ignitor 13 would exhibit an intensity in the order of 2 milliamperes, i.e. much lower than the threshold intensity necessary to operate ignitor 13, or, in other words, much lower than the maximum non-trigger current which is in the order of 130 milliamperes. Thus, the resistor 27 fulfils a double function in the pyrotechnic circuit: it limits the current while the capacitor 29 is loading; it protects the ignitor 13 in the very improbable simultaneous failure of the transistors 21, 22 and 23.

During the test, the transistor 19 loads the 100 μF firing capacitor 29 under a 3 V voltage. The energy referred to the ignition resistor is then 0.16 mJ/ohm. This value is lower than the maximum non-trigger energy, which is 0.16 mJ for 5 μF. Thus, the charge of the firing capacitor during the test phase does not exhibit any dangers.

By injecting current, the test circuit is capable to detect the presence of the ignition resistance of ignitor 13. This current is in the order of 1 mA, i.e. below the maximum non-trigger intensity threshold, which is in the order of 130 mA.

Figure 5:
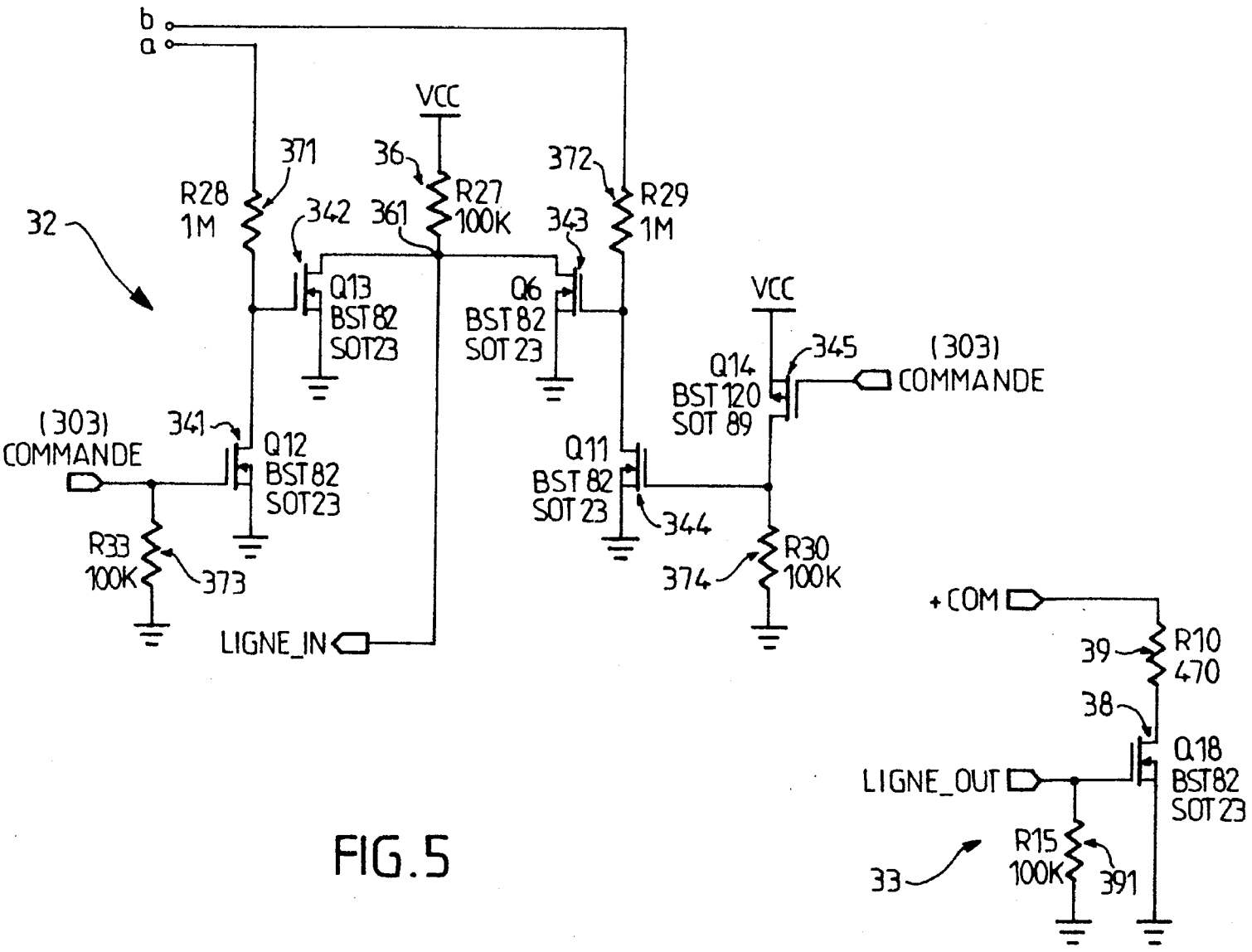
FIG. 5 is a representation of the communications interface of the same ignition module.

The communications interface of an ignition module has been represented more specifically on FIG. 5. It comprises a receiver sub-assembly 32 and a transmitter sub-assembly 33. Both these sub-assemblies 32 and 33 ensure bidirectional link with, on the one hand the firing console 17 and on the other hand the programming console 18 when it is linked to the module 15.

The receiver sub-assembly 32 is designed to detect the polarity changes applied on the line by the firing console 17 or programming console 18 consoles. It comprises mainly four N-channel field effect VMOS transistors, 341 to 344, each mounted to a common source which is grounded directly, and a P-channel field effect VMOS transistor 345 mounted to a common drain which is grounded via a resistor 374. The gate of the transistor 341 is linked on the one hand to the microsystem management logic unit 303 and on the other hand to a resistor 373 via which the gate is grounded. The drain of the transistor 341 is linked on the one hand to the gate of the transistor 342 and on the other hand via a resistance 371 linked to the supply module, described more in detail with reference to FIG. 6.

The drain of the transistor 342 is linked to a common pin 361 to which a resistor 36, the drain of the transistor 343 and the line are also connected. The common pin 361 is connected via the resistance 36 to the operating voltage Vcc.

The gate of the transistor 343 is linked via a resistor 372, to the supply module and to the drain of the transistor 344. The gate of the transistor 344 is grounded via a resistor 374 and linked to the drain of the transistor 345. The source of the transistor 345 is linked to the Vcc operating voltage and the gate of the transistor 345 is connected to the microsystem management logic unit 303.

The transistors 342 and 343 convert the line switching into pulses which can be understood by the logic unit 303. The transistors 341 and 344 fix the permanent condition of the "line in" signal at lower level. Since the receiver sub-assembly 32 is sensitive to polarity only and not to the amplitude of the signals applied to its input, this sub-assembly is more tolerant to line loss phenomena.

The transmitter sub-assembly 33 comprises an N-channel field effect VMOS transistor 38 and two resistors 39 and 391. The transistor 38 is mounted to a common source and the source is grounded directly. Its gate is grounded via the resistor 391 and linked to the output line. The drain of the transistor 38 is linked, via the resistor 39, to the E line voltage. The 470 ohm resistor 39 creates a current overconsumption over the E line when a voltage pulse is provided by the output line of the microcontroller to the gate of the transistor 38.

Figure 6:
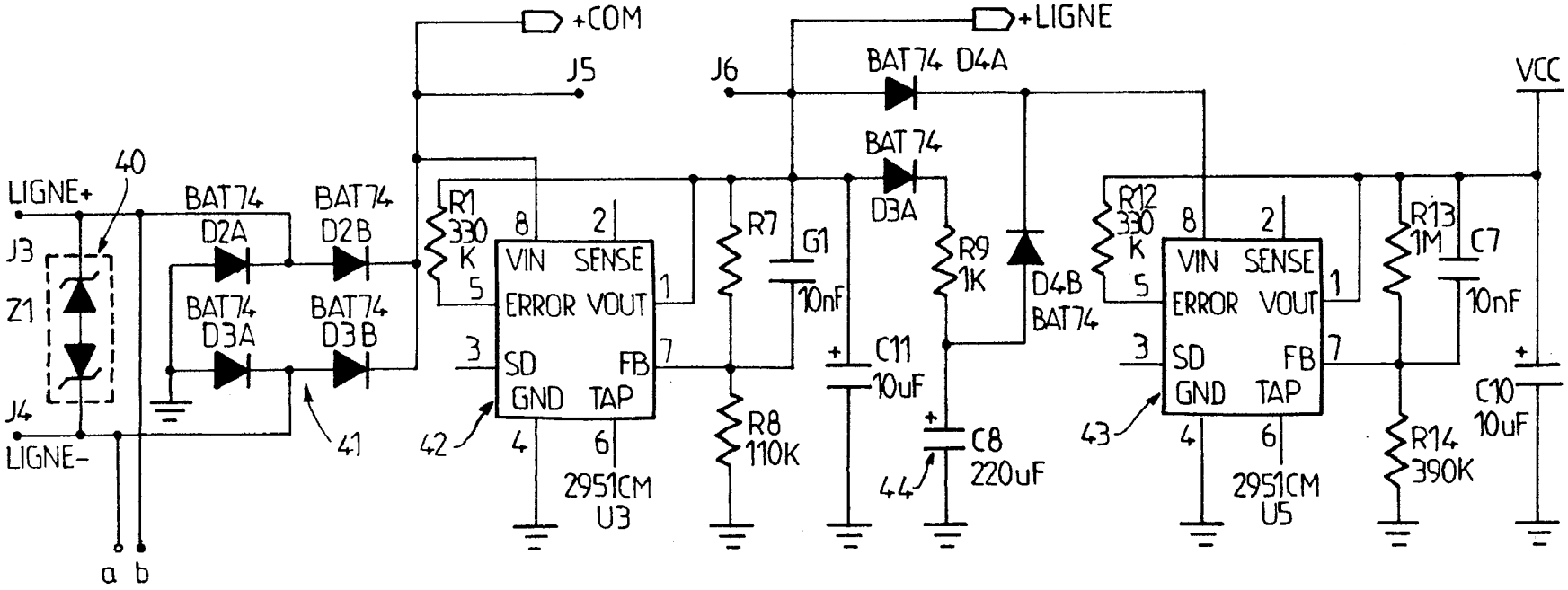
FIG. 6 is a representation of the supply circuit of the same ignition module.

The supply of an ignition module 15 is represented on FIG. 6. This circuit is designed to provide a direct voltage of approximately 4 volts, including during the firing phase. This module comprises essentially a pair of Zener diodes 40, a rectifier bridge 41, a first voltage regulator 42, a second voltage regulator 43 and a 1000 μF capacitor 44.

The rectifier bridge 41 directs the voltage from the line and frees the ignition module from any polarization.

The first voltage regulator 42 guarantees a 12 volt charging voltage to the capacitor 44 for a line voltage comprised between 12 and 30 volts in "absolute value".

The second voltage regulator 43 uses, in order to supply 4 volts to the rest of the system, the line voltage or the energy stored by the capacitor 44.

Figure 7:
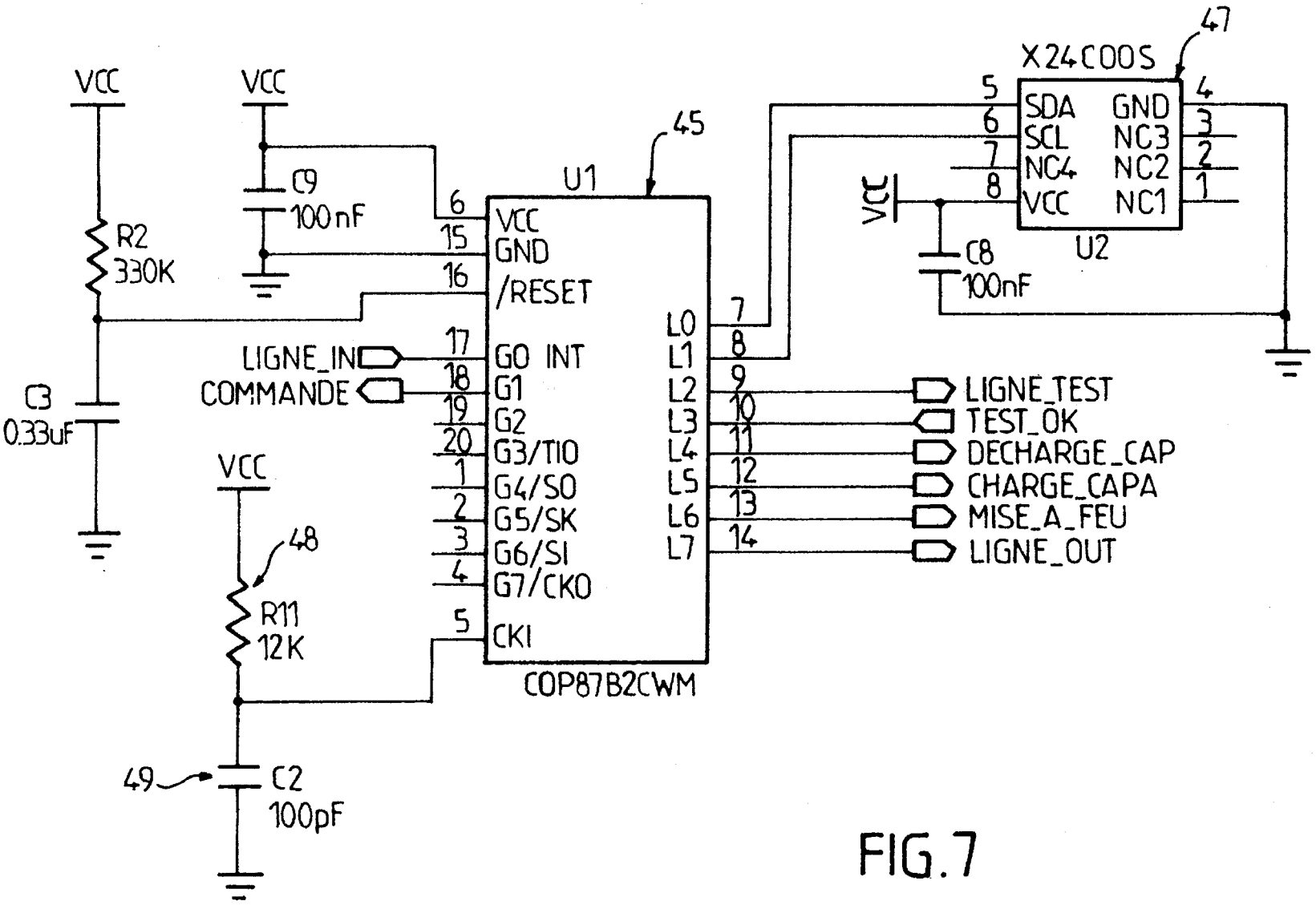
FIG. 7 is an illustrative representation of the logic unit of the same ignition module.

The logic unit 303 managing every ignition module 15 is of classical type. It is represented on FIG. 7.

The logic unit 303 manages the communications with the line, as well as the controls of the pyrotechnic charge. It comprises a microcontroller 45, including a programme memory, as well as an EEPROM-type "delay time" 47 memory selected. Storing of the delay time is thus permanent, but can be erased at any time and reprogrammed electrically.

The technology of the microcontroller 45 enables as small a consumption as possible, appropriate speed of execution and sufficient quantity of input and output ports.

In order to create optimum industry conditions (functional reliability in operating environment and manufacturing cost as small as possible), the time base is not driven by a quartz, but by a simple RC circuit, referred to as 48 and 49.

The manufacturing tolerances of the standard R and C components being ±10%, the oscillation frequency of each clock may vary by ±20% with respect to the accuracy required for the delay time of the ignition module.

If it is accepted that the time base, or the management clock of an ignition module, can be false by ±30% with respect to the typical value desired, delay times can be guaranteed with an accuracy better than 0.5 millisecond. During the programming of every ignition module, its time base, which is false by manufacture, is measured precisely with respect to the quartz of the programming console.

The calibration error of the management clock is measured and a corrective factor for tuning to the accurate value desired is calculated and applied to the ignition module in order to obtain the correct delay.

The firing consoles 17 and the programming consoles 18 will now be described. They are similar in structures and differ mainly by their functionality and hence by the associated management softwares. Every console comprises:

a logic unit based on a microcontroller, for example of the type marketed by the MOTOROLA company under the 68HC11 designation and which integrates 512 bytes of EEPROM memories enabling to store in a non-volatile way, certain operating parameters, such as the module delays programmed, a RAM memory, an input and output network, an RS232 type interface, so that the firing console 17 and programming console 18 may communicate with each other;

an LED liquid crystal display;

a supply unit which provides ±5 volts to the logic unit and ±10 volts to the line interface, whereas the upstream voltage equals 15 volts;

a line interface made of two sub-systems, amongst which a transmission section that is a stabilized supply able to switch in order to deliver plus 12 or plus 6 volts and a receiving section which measures the current used on the line and which detects the transient overconsumptions of the ignition modules 15.

The programming console 18 comprises a 12 key alphanumeric keypad and a red light-indicator and makes six functions available:

programming of the delay time of an ignition module 15;

clearing the screen;

erasing the contents from the delay time storage memory of an ignition module 15;

testing an ignition module;

reading the delay time of an ignition module;

transferring the delay times of the firing modules programmed to the firing console.

The implementation procedure is the following: the operator enters the delay time desired in milliseconds using the keyboard. The delay times may vary from 1 to 3000 milliseconds. They are different for every ignition module and are used for identification during the dialogues between the ignition modules and the consoles. For pyrotechnicians, an 8 millisecond difference between two detonator delay times is irrelevant. It is thus possible, if one wishes to make several detonators explode in a synchronous way from a pyrotechnic viewpoint, to provide them with delay times which are offset with respect to one another by millisecond increments.

As a variation, every delay time may be added a programming order number. Using this measurement, it is possible to assign the same delay time to several control modules, while addressing every control module individually.

The operator then validates the delay time while depressing the appropriate validation key. The console 18 sends the programming order to the ignition module 15 and asks for a reading of the delay time programmed. If the pieces of information returned by the module correspond to those programmed, to one millisecond, the screen of the console 18 displays that the programming is correct. Failing which, the console 18 requests the programming to be entered all over again.

The erasing function is used if the operator has made a mistake when entering the delay time. After programming every ignition module 15, the delay time is stored in an EEPROM memory of the programming console 18. Once all the delay times have been programmed and stored, they are transferred to the firing console 17, automatically during connection between both consoles, via the RS232-type series link, using a transfer function designed on the programming console 18. An internal auto-test also enables testing of every ignition module 15. The feedback indication is global. A red light-indicator signals any incorrect procedure or prompts the operator to confirm his choice.

The firing console 17 comprises three keys: test/arming/fire, two green and red light-indicators for the testing phase and a magnetic card appropriate to the firing console; it exhibits five functions: automatic transfer of the data from the programming console 18; testing the ignition modules 15; cancelling the fire; charging the reservoir capacitors 29; fire.

A firing sequence is implemented as follows. Once the ignition modules 15 have been programmed using the programming console 18 and, as indicated above, the programmed delay times will be transferred from the EEPROM memories of the programming console 18, to the EEPROM storage memories of the firing console 17, after insertion of the appropriate magnetic card or any other safety device into the firing console in order to authorize connection to the programming console. Once the transfer has been completed, the operator sends to the firing console 17 an order to test the ignition modules 15 on-line.

Every ignition module 15 sends back over the line binary information relating to its operating condition: "correct module" or "incorrect module" type information, or more complicated data if required.

Figure 8A:
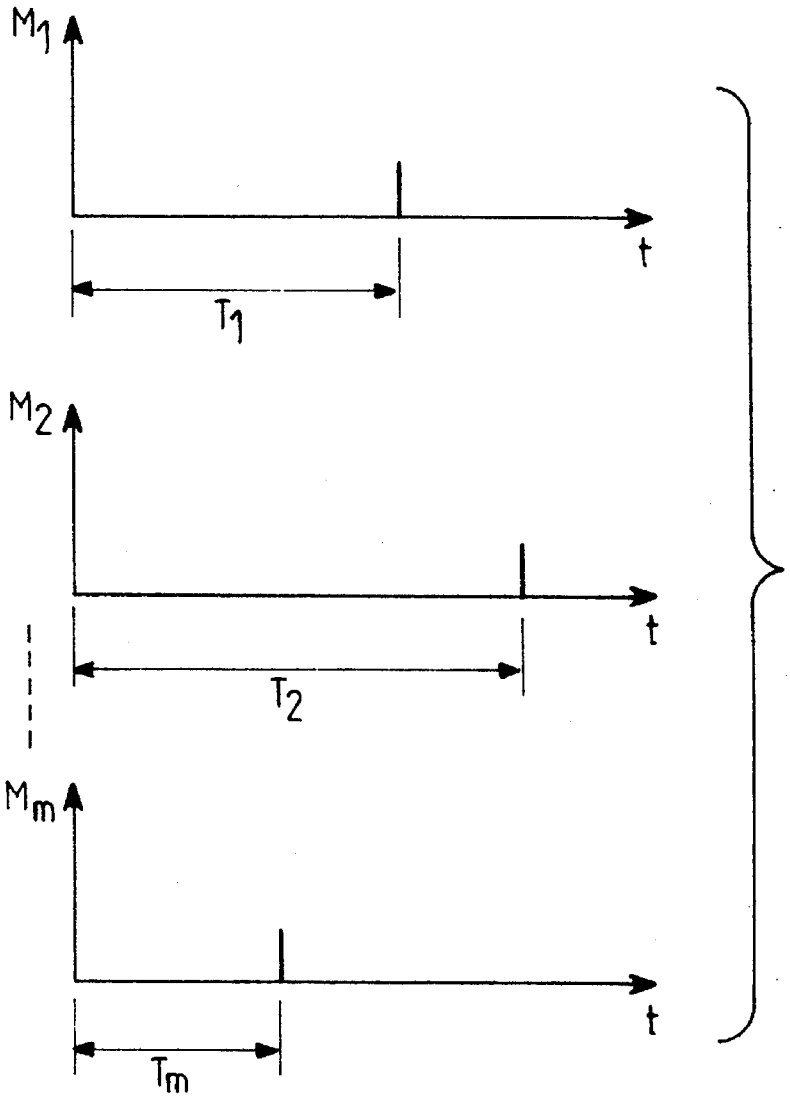
FIG. 8A and 8B are schematic illustrations of the communications principle, according to a preferred embodiment during transmission (A) and reception (B).
Figure 8B:
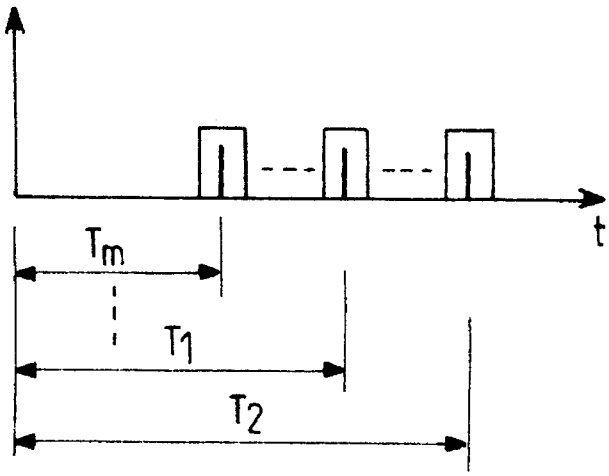

The pulses transmitted to the firing console 17 are sent back for every ignition module 15 with a delay time corresponding to that programmed for that module 15. Upon reception, the firing console 17 opens a gate time for every detonator, around the delay time programmed by the console 18 and available in memory. It is the delay time with which the console 17 must receive information, that enables to identify the module 15 which it originates from, whereas this delay time corresponds to that programmed for that module. This requires that delay times have been transferred by the programming console to the firing console memory. This information transfer from the ignition modules 15 on-line has been illustrated more specifically on FIGS. 8A and 8B, FIG. 8A shows the timing diagram during transmission and FIG. 8B shows the timing diagram during reception.

Upon reception of the test order, the modules 15, referred to by $M_1, M_2 \ldots M_m$, send back to the firing console 17, one or several binary pulses which correspond to the information to be transmitted to the firing console 17. The pulses are offset with respect to a zero time reference, identical for every ignition module, by a $T_1, T_2 \ldots T_m$ time, corresponding to the firing delay time according to which the $M_m$ module sending the information back, has been programmed. The firing console 17 will open as many time observation gates $F_1$, $F_2$, $F_m$ as there are $M_m$ ignition modules. For a 250 microsecond pulse, the time observation windows $F_1, F_2, F_m$ opened by the firing console 17 could be in the order of 750 microseconds (250 microseconds before and after the pulse).

Once this test has been completed, the operator orders the ignition modules 15 to load the capacitors, from the firing console 17. A message validates the execution of this loading.

At any moment, the operator has the possibility to cancel the firing procedure and to order the ignition modules 15 to discharge their reservoir capacitors. After loading, the console 17 waits for the firing order. After validation, the firing order is given to the various ignition modules.

One advantage of the ignition module which has just been described, is that it does not contain any energy sources. It is thus highly reliable, since it does not exhibit any risks of untimely firing of the pyrotechnic charge as long as the detonator, with which that ignition module is associated, has not been mounted on-line. The discharge of tile capacitor 29 of an ignition module 15 will be controlled either directly by an operator from the firing console 17, or internally by the ignition module itself, four seconds after cutting the line wires, once the first detonator has exploded.

Numerous safety procedures have been designed as well. Access to the firing consoles and to the programming consoles will require the operator to know recognition codes. The firing and programming consoles, as well as the ignition modules can be customized in factory before shipment. A recognition system can also be integrated between the programming consoles and the firing consoles. In case of theft especially, an operator could use a firing console only if said console matches the programming console used to programme the ignition modules 15. Recognition of the programming console by the firing console via an internal code will be designed to this end. If the code is not recognized, the firing console will not record the information concerning the delay time stored in the programming console. Fire will be inhibited.

Moreover, the firing console can be fitted with a magnetic card authorizing its use.

It should also be noted that, although the unit has been designed for on-site programming, factory programming is readily available for people who do not wish any on-site programming.

In the circuits represented on the various figures, certain connection points are designated by signal names or voltage type indications. Points showing the same name are to be interconnected.

The sole purpose of the reference signs inserted after the technical characteristics mentioned in the claims is to facilitate the understanding of said claims and do not limit their extent whatsoever.

We claim:

1. Method of controlling detonators fitted with integrated delay electronic ignition modules (15), each detonator having an ignition module and an ignitor, each ignition module (15) comprising a first reservoir capacitor (29) designed, after loading, to discharge in an associated ignitor (13) in order to generate a firing electrical pulse, a time base as well as logic unit (303) comprising a second reservoir capacitor (44) designed to supply the necessary energy to the rest of the logic unit, if line voltage is cut off, and a memory in order to store in said ignition module (15) a delay time for the explosion of said detonator, during a firing sequence, said ignition modules being able to communicated with a firing control unit (17) designed to transmit to said ignition modules an order to load the first reservoir capacitor (29) as well as a firing order and to receive from said modules, data about their conditions, said method comprising: before a firing sequence, storing individual ignition module delay times in the ignition modules via a programming unit (18), wherein, once the ignition modules have been programmed, the delay times programmed are stored in the firing control unit (17) via the programming unit (18), the firing control unit (17) can interrogate the ignition modules simultaneously, said ignition modules send the data requested back to said firing control unit (17), and all steps for said method are executed by signals exhibiting an intensity substantially less than a threshold intensity necessary to operate the ignitor (13).

2. Method according to claim 1, further comprising during programming, measuring the time base of every ignition module.

3. Method according to claim 1, wherein the delay times are different for every module (15) and the modules send the information requested back after a feedback time with respect to the delay time stored in each of them, said firing control unit (17) opening reception gate time corresponding to the feedback time.

4. Method according to claim 1, wherein the ignition modules send back to the firing control unit (17) the information requested, according to a time sequence corresponding to the firing time sequence.

5. Method according to claim 1, wherein the firing control unit (17) interrogates simultaneously the ignition modules via an on-line test order, before a loading phase and a firing phase and the ignition modules send back to the firing control unit (17) global information about their condition.

6. Encoded firing control assembly comprising a firing control unit (17), plural ignition modules (15) with intergrated electronic delay for firing a detonator, each module being connected electrically on-line to said firing control unit (17), a two-wire line between the firing control unit (17) and each ignition module (15) for supplying power to said ignition modules, as well as for communications between said firing control unit (17) and said ignition modules (15) and an independent programming unit (18) connectible to said firing control unit and said plural ignition modules.

7. Assembly according to claim 6, wherein each of the ignition modules comprise means enabling them to send to the firing control unit (17) information in the form of overconsumption of line current, whereas the firing control unit (17) is fitted with detection means of a line current overconsumption with respect to the average consumption of the ignition modules.

8. Encoded firing control assembly according to claim 6, wherein every ignition module comprises a time base formed by an RC circuit.

9. Assembly according to claim 6, wherein the programming unit (18) is able to communicate separately with every ignition module (15) to store the explosion delay times in said ignition modules, and the firing control unit (17) is able to monitor the firing phases during a firing sequence.

10. Assembly according to claim 9, wherein the programming unit (18) is fitted with means for the storing of all the delay times which have been programmed and are transferred separately by the programming unit to every ignition module, and the firing control unit (17) and the programming unit (18) are able to communicate in order to enable transfer, before a firing sequence, of all the delay times programmed.

11. Assembly according to claim 6 wherein the firing control unit (17) and programming (18) unit are fitted with encoding means designed to limit access to only authorized people and with means for internal mutual recognition before transfer of the delay times programmed of the programming unit (18) to the control unit (17).

12. Detonator ignition module for a detonator having a pyrotechnic charge, said module comprising a supply circuit, a communication interface, a management circuit of the pyrotechnic charge, said management circuit including a reservoir capacitor (29) designed, after loading, to discharge in an ignitor (13) of said detonator, a logic unit (303) for the management of the module, a supply source of line voltage mounted in series with the reservoir capacitor (29), a first switching transistor (21) to control the charge of said reservoir capacitor (29) and a resistor (27) linked by the one pin which is not connected directly to the reservoir capacitor (29) to a second switching transistor (22) to discharge said a reservoir capacitor (29) to ground.

13. Module according to claim 12, wherein the impedance between the supply of the management circuit of the pyrotechnic charge and the ignitor (13) is high enough so that the current generated by the line voltage in the ignitor (13) is, whatever the condition of the first and second switching transistors, less than the value of the operating limit current of said ignitor (13).

14. Module according to claim 13, wherein the value of said resistor (27) of the reservoir capacitor is high enough so that the current generated by said supply in the ignitor (13) is, whatever the condition of the first and second switching transistors, less than the value of the operating limit current of said ignitor.

15. An integrated delay electronic ignition module for controlling a detonator fitted with a pyrotechnic charge, said module comprising a supply circuit designed to be connected to a supply source having line voltage, a communication interface designed to establish a bi-directional communication path between the ignition module and one of a firing console and a programming unit, and a management circuit of the pyrotechnic charge; said management circuit including a reservoir capacitor designed, after loading, to discharge in an ignitor of its detonator in order to generate a firing electrical pulse, a time base as well as a logic unit fitted with a memory in order to store in said ignition module a delay time for the explosion of said detonator, during a firing sequence, a first switching transistor to control the charge of said reservoir capacitor from the supply source, a resistor linked by one pin not connected directly to the reservoir capacitor to a second switching transistor to discharge said reservoir capacitor to ground, and a third switching transistor which is a firing device of the pyrotechnic charge, said resistor being high enough value so that the current generated by said supply source in the ignitor is, whatever the condition of said first, second, and third switching transistors, less than a value of the operating limit current of said ignitor.

16. Module according to claim 15, wherein the impedance between the supply of the management circuit of the pyrotechnic charge and the ignitor is high enough so that the current generated by the supply source in the ignitor is, whatever the condition of said first, second and third switching transistors, less that the value of said operating limit current of said ignitor.

* * * * *